US005821443A

United States Patent [19]

Masubushi

[11] Patent Number: 5,821,443

[45] Date of Patent: Oct. 13, 1998

[54] KEYBOARD APPARATUS WITH AN IMPROVED MASS MEMBER SUPPORT SYSTEM

[75] Inventor: Takamichi Masubushi, Shizuoka-ken, Japan

[73] Assignee: Yamaha Corporation, Hamamatsu, Japan

[21] Appl. No.: 791,801

[22] Filed: Jan. 28, 1997

[30] Foreign Application Priority Data

Jan. 29, 1996 [JP] Japan ..... 8-012681

[51] Int. Cl.[6] ..... G10C 3/12

[52] U.S. Cl. ..... 84/433; 84/434

[58] Field of Search ..... 84/433, 434, 439, 84/440

[56] References Cited

U.S. PATENT DOCUMENTS 4,901,614 2/1990 Kumano et al. ..... 84/719

*Primary Examiner*—William M. Shoop, Jr.
*Assistant Examiner*—Shih-yung Hsieh
*Attorney, Agent, or Firm*—Pillsbury Madison & Sutro LLP

[57] ABSTRACT

A keyboard apparatus has a relatively simple structure to guide a mass member without using a spring to provide high quality performance with stable operation. The rotational moment force of the mass member acts in a uniform direction against a rotation support section that supports the mass member upon depression and release of an associated key so that the generation of mechanical noise and the development of clattering movement at the rotating support section are substantially prevented. The keyboard apparatus has a key that is movably supported on a support member, and a mass member rotatably supported by a rotation center section of the support section and driven by the key. The keyboard apparatus further includes a guide member that slidably guides the mass member and positions the mass member with respect to the key arrangement direction and at a specified location removed from the rotating center section of the mass member.

18 Claims, 9 Drawing Sheets

KEYBOARD APPARATUS WITH AN IMPROVED MASS MEMBER SUPPORT SYSTEM

BACKGROUND OF THE INVENTION

1. Field of the Invention

The present invention relates to a keyboard apparatus with mass members, such as hammers, used in an electronic musical instrument.

2. Description of Related Art

A typical electronic keyboard apparatus, such as an electronic piano, has hammers that move in association with corresponding keys to generate a weighty feeling and a key touch feeling that are equivalent to those of an acoustic piano when the keys are depressed by the fingers. For example, such an electronic keyboard apparatus is described in Japanese laid-open patent application SHO 63-125996. Upon depression of a key by the performer's finger, a hammer associated with the depressed key generates the force of inertia that is proportional to the mass of the hammer. The force of inertia acts as a counter force against the finger depressing the key.

Each hammer defines a mass member for each of the keys, and is rotatably mounted on a support member. The key has an abutting coupling section that pushes the hammer upon depression of the key. When the key is depressed, the hammer is pushed and rotated about its rotation center by the abutting coupling section of the key. The key is guided by a key guide in a generally vertical direction of the key depression stroke. As a result, yawing of the key (movements in a key arrangement direction in which the keys are arranged) and rolling of the key (rotations or twists about an axis extending in a front-to-end direction of the key) are prevented. However, the conventional keyboard apparatus does not have any special guide to guide the mass member (the hammer) itself. Instead, a spring is used to press the rotation center (rotation axis) of the mass member against the support member to position the mass member at a specified location with respect to the key arrangement direction or to prevent yawing of the mass member when the mass member rotates.

Also, to restrict the range of movements of the mass member, a first stopper and a second stopper are provided so that the hammer rests against the respective stoppers upon depression of the key and upon release of the key. Typically, the center of gravity of the mass member is located between one end of the mass member and the rotation center of the mass member. Conventionally, the first stopper and the second stopper are provided adjacent the one end of the mass member which is outside a range between the rotation center of the mass member and the center of gravity of the mass member. In other words, both of the stoppers are provided outside the range extending along a line connecting the rotation center of the mass member and the center of gravity of the mass member and outside the center of gravity. In addition to this particular stopper assembly structure, the conventional keyboard apparatus, as described above, does not have a guide for guiding the mass member (hammer). As a consequence, a strong spring is required to retain the mass member, resulting in a complicated assembly work, an increased number of parts and an increased manufacturing cost.

Furthermore, because the rotation center of the mass member is pushed with a substantially strong force from the spring, the frictional force between the mass member and the support member increases. As a result, the original weighty feeling that may be otherwise generated by the force of inertia of the mass member is affected by the friction caused by the spring. As a consequence, a stable key touch feeling is not provided. Moreover, the increased friction changes the key depression feeling and the performance of the keyboard apparatus.

Furthermore, when the hammer abuts against the first stopper and the second stopper upon depression of the key and upon release of the key, the rotational moment force of the hammer's center of gravity acts against the rotating shaft section or the sliding fulcrum section of the hammer. As a result, mechanical noise is generated and clearances about the rotating shaft support section of the frame gradually become larger as the apparatus is used over a long period of time, resulting in even more mechanical noise.

The conventional keyboard apparatus typically has a coupling structure in which the mass member and the key are coupled by means of a shaft. To study the characteristics of impacts generated when the keyboard apparatus falls, an instrument fall simulation test is performed. It has been found that the impact force acting on the mass member of the conventional keyboard apparatus directly propagates to the key support section and is likely to damage the key support section.

Also, in the conventional apparatus, the key and the mass member must be mutually positioned with high precision in order to bring the abutting section of the key in secure contact with the abutting section of the mass member. This positioning operation is difficult and complicated.

SUMMARY OF THE INVENTION

It is an object of embodiments of the present invention to provide a keyboard apparatus that has a relatively simple structure to guide a mass member without using a spring and yet provides a stable operation of the mass member that results in high quality performance.

It is another object of embodiments of the present invention to provide a keyboard apparatus in which a rotational moment force of a mass member acts in a constant direction against a rotation support section that rotatably supports the mass member upon depression and release of an associated key so that the generation of mechanical noise and the development of clattering movements at the rotation support section are substantially prevented.

It is still another object of the present invention to provide a keyboard apparatus for a musical instrument, such as, for example, an electronic piano and the like, in which the impact force acting on the mass member does not directly propagate to a key supporting section when the musical instrument falls. As a result, damage to the key supporting section is substantially prevented.

It is a further object of the present invention to provide a keyboard apparatus having at least a key and a thin plate supporting section for supporting the key. The key has a performance operation section which is normally a top surface of the key on which the performer's finger strikes. In accordance with an embodiment of the present invention, the keyboard apparatus has a system that substantially prevents damage to the thin plate supporting section no matter what area of the performance operation section is depressed.

To achieve the above-described objects, a keyboard apparatus in accordance with an embodiment of the invention includes: a support member, at least a key rotatably supported on the support member and having an abutting section, a mass member moveably supported on the support member and driven by the abutting section of the key; and a novel guide device. In one embodiment, a guide device allows the mass member to rotate and positions the mass member with respect to a key arrangement direction (the keyboard's lengthwise direction) at a position removed from its rotation center section.

When the mass member is driven and rotated by the key, the guide device positions the mass member with respect to the key arrangement direction and guides the mass member in a vertical direction at a position other than the rotation center section. As a result, a spring is not required to push the rotation center section of the mass member with a substantial force. As a consequence, the number of assembly parts is reduced and the assembly time is shortened, resulting in a reduced cost. Also, the operational unstableness due to friction working on the rotation axis section is substantially eliminated, and a stable key touch feeling and a stable weighty feeling are generated without regard to the amount of grease that may be used for reducing friction at the rotation axis section.

A keyboard apparatus in accordance with another embodiment of the invention includes: a support member having a sliding coupling section, at least a key moveably supported on the support member and having a key supporting section and an abutting section, a mass member slidably supported by the sliding coupling section of the support member and driven by the key at the key abutting section; and a novel guide device. A guide device positions the mass member with respect to the key arrangement direction and a key front-to-rear direction (which is transverse to the key arrangement direction) and moveably guides the mass member. As a result, range of movement of the mass member in the front-to-rear direction and the key arrangement direction is restricted. Accordingly, when a musical instrument that incorporates the keyboard apparatus falls, the impact force inflicted on the mass member is received by the guide device so that excessive force does not propagate to the key support section and thus the musical instrument is substantially protected from damages.

A keyboard apparatus in accordance with another embodiment of the invention includes: a support member; a key moveably supported on the support member; a mass member driven by the key and moveably supported on the support member; and a guide member that moveably guides and positions the key with respect to the key arrangement direction. In one embodiment, the guide member for guiding the key and the mass member is formed from a common member. As a result, the number of parts is reduced, the structure is simplified and assembly becomes easier, with the result that the cost is reduced. Furthermore, the application of grease and maintenance work are facilitated.

In accordance with another embodiment of the present invention, the key and the mass member abut against each other at an abutting section that is located adjacent the common guide member, and the mass member is driven by the key through the abutting section. Because the abutting section between the key and the mass member is located adjacent the common guide member, the key, the mass member and the guide member are accurately positioned with respect to one another and thus secure abutting contact between the key and the mass member is obtained.

A keyboard apparatus in accordance with another embodiment of the invention includes: a support member, at least a key having a key supporting section and a key abutting section, and a mass member moveably supported on the support member and driven by the key through the key abutting section. The support member moveably supports the key through the key supporting section of the key and moveably supports and positions the mass member with respect to the key arrangement direction. In one embodiment, one of the key and the mass member is slidably inserted in the other, and is prevented from yawing by a yawing prevention device. In a preferred embodiment, the mass member slidably receives a part of the key and moves in association with the key. The mass member is prevented from yawing by a member that positions the mass member with respect to the key arrangement direction and slidably supports the mass member. As a result, the key is positioned at a specified location and the key movement is guided without using a key guide. As a consequence, the frame structure is simplified and the cost is reduced.

A keyboard apparatus in accordance with another embodiment of the invention includes: a support member, at least a key rotatably supported on the support frame and having an abutting section, and a mass member having a rotation center. The mass member is moveably supported on the support member and driven by the key through the abutting section. The keyboard apparatus further includes a first stopper that restricts movements of the mass member caused by a key depression operation, and a second stopper that restricts movements of the mass member caused by a key release operation. In one aspect of embodiments of the present invention, the mass member has a center of gravity on an opposite side of the key abutting section with respect to a vertical plane including the rotation center. When the mass member abuts against the first stopper, the first stopper is positioned between a plane perpendicular to a line connecting the rotation center and the center of gravity and including the rotation center and a plane perpendicular to the line connecting the rotation center and the center of gravity and including the center of gravity. When the mass member abuts against the second stopper, the second stopper is positioned adjacent the center of gravity and outside an area between a plane perpendicular to a line connecting the rotation center and the center of gravity and including the rotation center and a plane perpendicular to the line connecting the rotation center and the center of gravity and including the center of gravity.

When the mass member abuts against the first stopper upon depression of the key, the rotational moment force at the center of gravity of the mass member acts downwardly with respect to a rotation support section of the support member on which the center of rotation is rotatably supported. When the mass member abuts against the second stopper upon release of the key, the rotational moment force at the center of gravity of the mass member also acts downwardly with respect to the rotation support section. Therefore, the rotation center of the mass member normally applies a constant downward force against the rotation support section. As a result, structural strength is not required in both of the upper and lower structures with respect to the rotation support section, but required only in one direction, for example, only in the lower structure. Accordingly the structure of the keyboard apparatus is simplified. Moreover, mechanical noise is reduced. When the mass member abuts against the stopper at the end of the key depression operation, the mass member substantially does not bounce on the stopper and therefore a rebounce of the mass member against the key substantially does not occur. Accordingly, when the key is depressed with an impact force, the "key vibrating feeling" is not generated. Also, development of clattering movement at a shaft bearing aperture around the rotation support section of the mass member at the rotation center, that may otherwise be caused by alternate upward and downward forces, is substantially prevented, and thus development of the mechanical noise is essentially eliminated.

A keyboard apparatus in accordance with another embodiment of the invention includes: a support member having a sliding contact section, at least a key moveably supported on the support member and having an abutting section and a supporting section, and a mass member having a rotation center section and a sliding coupling point in contact with the abutting section of the key. The mass member is moveably supported on the sliding contact section of the support member and driven by the key through the abutting section. The keyboard apparatus includes a first stopper that restricts movements of the mass member caused by a key depression operation, and a second stopper that restricts movements of the mass member caused by a key release operation. In one aspect of embodiments of the present invention, the mass member has a center of gravity on an opposite side of a vertical plane oriented in the key arrangement direction and including the sliding coupling point with respect to the rotation center section. When the mass member abuts against the first stopper, the first stopper is positioned between a plane perpendicular to a line connecting the sliding coupling point and the center of gravity and including the sliding coupling point and a plane perpendicular to a line connecting the sliding coupling point and the center of gravity and including the center of gravity. When the mass member abuts against the second stopper, the second stopper is positioned adjacent the center of gravity and outside an area between a plane perpendicular to a line connecting the sliding coupling point and the center of gravity and including the sliding coupling point and a plane perpendicular to the line connecting the sliding coupling point and the center of gravity and including the center of gravity.

When the mass member abuts against the first stopper upon depression of the key, the rotational moment force at the center of gravity of the mass member acts downwardly with respect to the sliding contact section of the support member. When the mass member abuts against the second stopper upon release of the key, the rotational moment force at the center of gravity of the mass member also acts downwardly with respect to the sliding contact section of the support member. As a result, the structure of the keyboard apparatus is simplified, mechanical noise is reduced and generation of key vibration is substantially prevented.

A keyboard apparatus in accordance with another embodiment of the invention includes: a support member, at least a key rotatably supported by the support member and including an abutting section, a mass member including a rotation center section and driven and rotated by the key through the abutting section, a first stopper that restricts rotational movements of the mass member caused by a key depression operation, and a second stopper that restricts rotational movements of the mass member caused by a key release operation. The mass member has a center of gravity on an opposite side of the key abutting section with respect to a vertical plane including the rotation center section. When the mass member abuts against the first stopper, the first stopper is positioned between a plane perpendicular to a line connecting the rotation center section and the center of gravity and including the rotation center section and a plane perpendicular to the line connecting the rotation center section and the center of gravity and including the center of gravity.

When the mass member abuts against the first stopper upon depression of the key, the rotational moment force at the center of gravity of the mass member normally acts downwardly against a rotation support section of the support member on which the rotation center section is supported. As a result, the structure is simplified, mechanical noise is reduced and generation of key vibrations is substantially prevented.

A keyboard apparatus in accordance with another embodiment of the present invention includes: a support member including a sliding contact section, a key including an abutting section and a supporting section, the key being moveably supported by the support member at the supporting section, a mass member having a sliding coupling section driven by the abutting section of the key, a first stopper that restricts movements of the mass member caused by a key depression operation, and a second stopper that restricts movements of the mass member caused by a key release operation. The mass member has a center of gravity on an opposite side of a vertical plane oriented in a key arrangement direction and including the sliding coupling section with respect to a rotation center or the mass member. When the mass member abuts against the first stopper, the first stopper is positioned between a plane perpendicular to a line connecting the sliding coupling section and the center of gravity and including the sliding coupling section and a plane perpendicular to the line connecting the sliding coupling section and the center of gravity and including the center of gravity.

When the mass member abuts against the first stopper upon depression of the key, the rotational moment force at the center of gravity of the mass member normally acts downwardly on the sliding contact section of the mass member. As a result, the structure is simplified, mechanical noise is reduced and generation of key vibration is substantially prevented.

A keyboard apparatus in accordance with another embodiment of the present invention includes: a support member, a key moveably supported on the support member, a key guiding protrusion member connecting to the key, and a mass member moveably supported by the support member and moved by the key. In one embodiment of the present invention, the key guiding protrusion member includes a vertical member downwardly extending from the key and a horizontal section horizontally extending from a tip of the vertical section, and the mass member is driven by the key guiding protrusion member. A major part of a compression force that is generated upon depression of the key acts on the vertical member of the key guiding protrusion member, and the vertical member has a substantial bending and compression strength. As a result, the members of the key do not substantially deform when the key drives the mass member, and thus mechanical strength of the key is enhanced.

A keyboard apparatus in accordance with another embodiment of the present invention includes a key having a key abutting section and a mass member driven and moved by the key through the key abutting section. The key has a rear end section and a base section connected to the rear end by a thin plate member. The base section of the key is connected to a support member so that the key is moveable due to flexible deformations of the thin plate member. The key abutting section is located below and between a depressible key front end position of the key and a depressible key rear end position of the key. Stoppers are provided above, below and adjacent a connection section between the rear end section of the key and the thin plate member for preventing excessive deformation of the thin plate member.

When a depressible area on a white key, for example at the front tip portion of the white key, is struck with a substantial force, the key tends to rotate counterclockwise about the abutting section between the key and the mass member. As a result, the thin plate member upwardly deforms. However, the deformation is restricted by the upper stopper. As a consequence, excessive deformation of the thin plate members is prevented and the resultant destruction is prevented.

On the other hand, when a depressible rear end area of the key is struck with a substantial force, the key tends to rotate clockwise about the abutting section between the key and the mass member. As a result, the thin plate member downwardly deforms. However, the deformation is restricted by the lower stopper. As a consequence, an excessive deformation of the thin plate members is prevented and the resultant destruction is prevented.

In accordance with an embodiment of the present invention, the stoppers clamp the base section and are fixed to the support member.

As a result, the distance between a position where the stoppers are fixed on the frame and a position where the stoppers stops movement of the key is shorter, and the stoppers are directly fixed to the base section of the key. As a consequence, the clearance at the stopper section is maintained with a high precision during assembly, and thus the number of assembly steps and the cost are reduced.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

PREFERRED EMBODIMENTS

Figure 1:
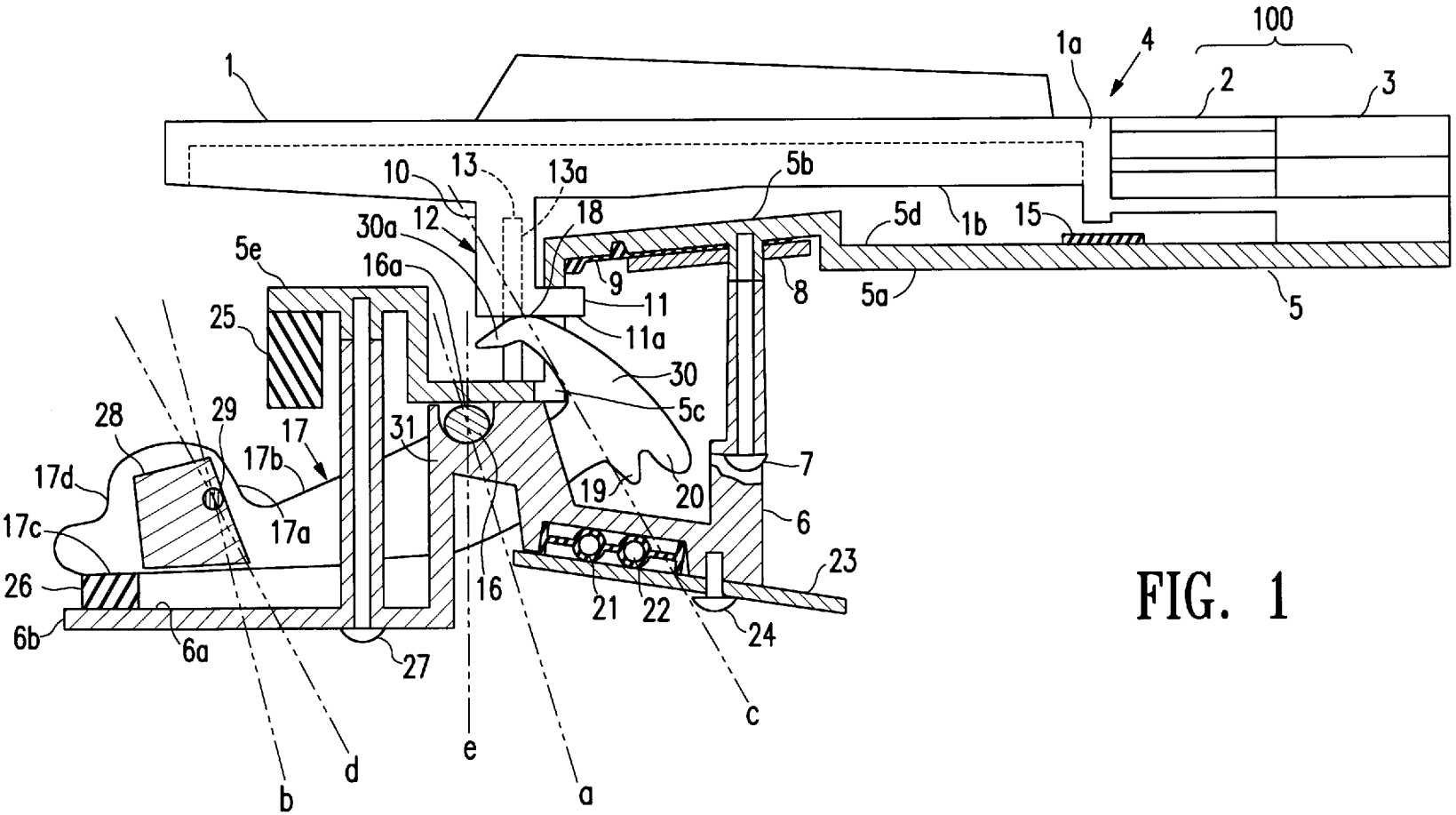
FIG. 1 shows a cross-sectional view of a keyboard apparatus in accordance with an embodiment of the present invention.

FIG. 1 shows a cross-sectional view of a keyboard apparatus in accordance with an embodiment of the present invention. A key 1 (e.g., white key) connects at its rear end section 1 a to a base plate 3 through a thin plate member 2. For example, a key unit 4 is formed from the white keys 1 and black keys for one octave. The key unit 4 for one octave, in accordance with the illustrated embodiment, is divided into three key blocks. Three base sections 3 at the rear end of the respective key blocks are stacked one on top of another. The key unit 4 is fixed at the base section 3 to a key frame 5 by an appropriate method, such as, for example, screws, bolts and nuts, and the like (not shown). Accordingly, each of the keys 1 is moveably supported with respect to the key frame 5 with the thin plate member 2 functioning as a hinge. In other words, a support section 100 is formed at the rear end of the key 1, and the key is moveably supported by the support section 100.

A hammer frame 6 is affixed to a lower side 5*a* of the key frame 5 by screws 7 and 27. Furthermore, a flexible sheet, such as, for example, a rubber sheet 9 is attached by a rubber retainer 8 to the key frame 5 at the lower side 5*a* and in a central area 5*b* of the key frame 5. The rubber sheet 9 has the following functions. Each of the keys 1 has a protruding section 12 and a horizontally extending section 11 connecting to the protruding section 12. When the key unit 4 is mounted on the key frame 5, the key unit 4 is rotated about the base section 3 so that the horizontally extending section 11 at the protruding section 12 moves down and through an opening 5*c* defined in the key frame 5. At this point, the rubber sheet 9 elastically deforms to allow the horizontally extending section 11 to pass through the opening 5*c*. Because the key frame 5 restricts the rubber sheet 9 from upwardly deforming, the horizontally extending section 11 of the key is prevented by the rubber sheet 9 from upwardly moving and passing through the opening 5*c* after the key unit 4 is mounted on the key frame 5.

The key 1 has a U-shaped cross-section with its bottom side 1*b* being open. The key 1 has side walls 1*c* that are connected to the protruding section 12. The protruding section 12 includes vertical sections 10 extending downwardly from the side walls 1*c* of the key 1. The vertical sections 10 are connected to the horizontal sections 11 that laterally extend from the tip of the vertical sections 10.

A guide member 13 is provided on the key frame 5 at a location where the guide member 13 is positioned between the vertical sections of the protruding section 12. The guide member 13 serves as a common guide member that guides the key 1 as well as a hammer 17 (a mass member) (which will be described later). The key 1 is positioned at a predetermined location with respect to the key arrangement direction (the lateral direction) because the vertical sections 10 of the protrusion 12 are in sliding contact with an upper portion 13*a* of the guide member 13. As a result, yawing and rolling of the key 1 are prevented, and the guide member 13 guides the key depression stroke of the key 1 in a vertical direction.

A protective sheet 15 is attached to an upper surface 5*d* of the key frame 5 adjacent the rear end section 1*a* of the key 1. The protective sheet 15 functions as a lower stopper for the key and substantially prevents the key 1 from being damaged when the key 1 is depressed with a substantially large depression force.

A hammer 17 (a mass member) has a rotation support section 16 functioning as a rotation axis that is rotatably mounted on a support bearing section 31 of the hammer frame 6. The hammer 17 has an end section 30 including upper portions 30*a*. The end section 30 is positioned so that the guide member 13 is located between the upper portions 30*a* of the end section 30 (in a similar manner as does the protrusion 12 of the key 1). As a result, the hammer 17 is in sliding contact with the guide member 13. As a consequence, the hammer 17 is positioned at a specified location with respect to the key arrangement direction, yawing and rolling of the hammer 17 are substantially prevented, and the guide member 13 guides rotational movements of the hammer 17 in a vertical direction.

The end section 30 of the hammer 17 includes an abutting section 18 in the upper portions 30*a* thereof. The abutting section 18 abuts against a lower surface 11*a* of the horizontal section 11 of the protruding section 12 of the key 1. The abutting section 18 of the hammer 17 is driven by the key 1 as the key 1 is depressed, rotates about the rotating support section 16 and slides generally vertically along the guide member 13.

The end section 30 of the hammer 17 includes actuators 19 and 20 in the lower portions thereof. The actuators 19 and 20 move through apertures (not shown) defined in the hammer frame 6 to successively drive electrical conductive rubber switches 21 and 22. The actuators 19 and 20 define a two-make touch response switch. The electrical conductive rubber switches 21 and 22 are mounted on a printed circuit board 23 and fixed to the hammer frame 6 by screws 24.

A first stopper 25 is provided on the lower surface 5*a* adjacent a front end section 5*e* of the key frame 5 to restrict movement of the hammer 17 upon depression of the key 1. When the key 1 is depressed, the lower surface 11*a* of the horizontal section 11 of the protrusion 12 of the key 1 pushes down the abutting section 18 of the hammer 17, the hammer 17 rotates clockwise about the rotation support section 16, and an upper surface 17*a*, about a central area 17*b* of the hammer 17 abuts against the first stopper 25. As a result, the uppermost position of the hammer stroke is restricted by the first stopper 25.

A second stopper 26 is provided on an upper surface 6*a* adjacent a front end section 6*b* of the hammer frame 6 to restrict movement of the hammer 17 upon release of the key 1. When the key 1 is released, the hammer 17 rotates counterclockwise about the rotation support section 16 due to its own weight, a tip section 17*c* of the hammer 17 abuts against the stopper 26 at its lowermost position, and the rotation of the hammer 17 is stopped.

A weight 28 is provided in a front end portion 17*d* of the hammer 17. In one embodiment, the weight 28 is formed from a metal plate. However, any appropriate material may be used for the weight 28. In one embodiment, the weight 28 may be provided with a small protrusion on one side thereof (not shown), and a small through-hole (not shown), for receiving the protrusion of the weight 28, is drilled in the hammer 17. As a result, the weight 28 can be mounted on the hammer 17 by inserting the protrusion of the weight 28 in the hole drilled in the hammer 17. In an alternative embodiment, the weight 28 may be attached to either side of the hammer 17 with adhesive or the like. By providing the weight 28 on the hammer 17, the center of gravity 29 of the hammer 17 is located at a place adjacent the front end section 17*d* of the hammer 17.

Planes a and b in FIG. 1 are defined when the mass member 17 (hammer) abuts against the first stopper 25. Plane a is perpendicular to a line connecting a rotation center support section 31 of the hammer frame 6 and the center of gravity 29 and including the rotation center 16*a*. Plane b is perpendicular to the line connecting the rotation center support section 31 and the center of gravity 29 and including the center of gravity 29.

Planes c and d are also defined when the mass member 17 (hammer) abuts against the first stopper 25. Plane c is perpendicular to a line connecting the sliding contact section 18 and the center of gravity 29 and including the sliding contact section 18. Plane d is perpendicular to the line connecting the sliding contact section 18 and the center of gravity 29 and including the center of gravity 29. Reference character e denotes a vertical plane including the rotation center 16*a* of the hammer 17.

Figure 2A:
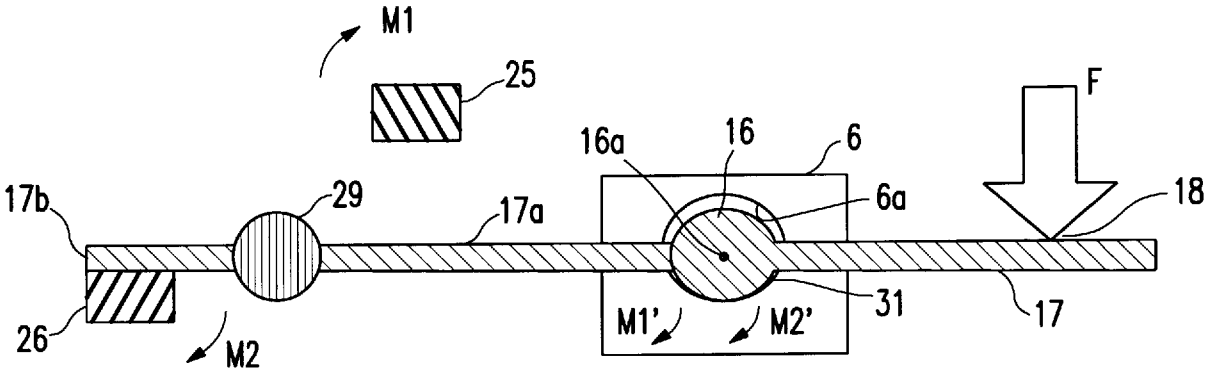
FIG. 2(A) schematically shows hammer and moment forces acting on the hammer in accordance with an embodiment of the present invention.
Figure 2B:
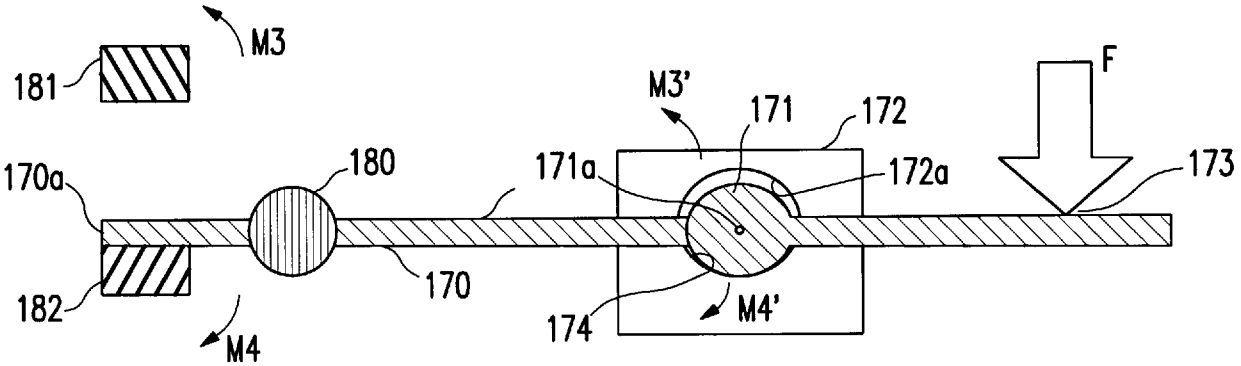
FIG. 2(B) PRIOR ART
FIG. 2(B) schematically shows hammer and moment forces acting on the hammer in a conventional keyboard apparatus.

FIG. 2(A) shows the relationship in positions among the center of gravity of the hammer 17, the first stopper 25 and the second stopper 26, in accordance with an embodiment of the present invention. FIG. 2(B) shows the relationship in positions among the center of gravity of the hammer 180, the first stopper 181 and the second stopper 182, in accordance with a conventional keyboard apparatus.

To clearly distinguish an embodiment of the present invention from the conventional keyboard apparatus, a structure of the conventional keyboard apparatus will be described first. In the prior art shown in FIG. 2(B), a hammer 170 has a rotation support section 171 that is rotatably mounted on a bearing section 174 of a hammer frame 72. A key depression driving force F from a key acts on an abutting section 173 and rotates the hammer 170 about the rotation support section 171. The center of gravity 180 of the hammer 170 is located in the hammer 170 on the opposite side of the abutting section 173 with respect to the rotation support section 171. A first stopper 181 is located, when the hammer 170 abuts against the first stopper 181, adjacent the center of gravity and outside of a range between a plane perpendicular to a line connecting a center of rotation 171*a* of the rotation support section 171 and the center of gravity 180 and including the center of rotation 171*a* and a plane perpendicular to the line connecting the center of rotation 171 a and the center of gravity 180 and including the center of gravity 180. A second stopper 182 is located adjacent the center of gravity 180 and outside of a range between a plane perpendicular to a line connecting the center of rotation 171*a* and the center of gravity 180 and including the center of rotation 171*a* and a plane perpendicular to the line connecting the center of rotation 171*a* and the center of gravity 180 and including the center of gravity 180.

In the conventional keyboard structure, when the key depression force F acts on the abutting section 173 upon depression of the key, the hammer 170 rotates clockwise about the center of rotation 171*a*, and an end section 170*a* of the hammer 170 abuts against the stopper 181. Due to the abutting impact force, a counterclockwise moment force M3 is generated. The moment force M3 causes a counterclockwise moment force M3' at the rotation support section 171.

On the other hand, upon release of the key, the hammer 170 rotates counterclockwise about the rotation support section 171 due to its own weight and the end section 170*a* of the hammer 170 abuts against the second stopper 182. Due to the abutting impact force, a clockwise moment force M4 is generated. The moment force M4 causes a clockwise moment force M4' at the rotation support section 171.

In the conventional keyboard structure described above, the moment forces in opposite directions act on the rotation support section 171 upon depression of the key and upon release of the key. As a result, mechanical noise is generated and clattering at an aperture 172*a* in the bearing section 174 of the hammer frame 172 gradually increases. Consequently, a stable counter force of inertia cannot be generated in response to a key depression operation. Furthermore, structural reinforcement is required in many directions due to the alternately generated moment forces and therefore the hammer frame structure cannot be simplified and the layout for the components is restricted.

In contrast, a structure in accordance with an embodiment of the present invention generates the following effects. As shown in FIG. 2(A), a hammer 17 has a rotation support section 16 that is rotatably mounted on a bearing section 31 of a hammer frame 6. A key depression driving force F from a key acts on an abutting section 18 and rotates the hammer 17 about the rotation support section 16. The center of gravity 29 of the hammer 17 is located on the opposite side of the abutting section 18 with respect to a vertical plane including a center of rotation 16*a* of the rotation support section 16. Namely, in the embodiment shown in FIG. 2(A), the center of gravity 29 is located on the hammer 17 on the opposite side of the abutting section 18 with respect to the rotation support section 16. A first stopper 25 is located, when the hammer 17 abuts against the first stopper 25, within a range between two planes. One of the planes is perpendicular to a line connecting the center of rotation 16*a* of the rotation support section 16 and the center of gravity 29 and including the center of rotation 16*a*, and the other plane is perpendicular to the line connecting the center of rotation 16*a* and the center of gravity 29 and including the center of gravity 29. A second stopper 26 is located adjacent the center of gravity 29 and outside a range between two planes. One of the planes is perpendicular to a line connecting the center of rotation 16*a* and the center of gravity 29 and including the center of rotation 16*a*, and the other plane is perpendicular to the line connecting the center of rotation 16*a* and the center of gravity 29 and including the center of gravity 29.

As a result, when the key depression force F acts on the abutting section 18 upon depression of the key, the hammer 17 rotates clockwise about the center of rotation 16*a*, and a section 17*a* between the center of gravity 29 and the center of rotation 16*a* abuts against the first stopper 25. Due to the abutting impact force, a clockwise moment force M1 is generated. The moment force M1 causes a clockwise moment force M1' at the rotation support section 16.

On the other hand, upon release of the key, the hammer 17 rotates counterclockwise about the rotation support section 16 due to its own weight and an end section 17*b* of the hammer 17 abuts against the second stopper 26. Due to the abutting impact force, a clockwise moment force M2 is generated. The moment force M2 causes a clockwise moment force M2' at the rotation support section 16.

In accordance with embodiments of the present invention, the moment forces work in the same downward direction with respect to the bearing section 31 of the hammer frame 6 upon depression of the key and upon release of the key. As a result, the force normally acts on the bearing section 31 of a shaft supporting aperture 6*a* of the hammer frame 6 so that the direction of the acting force does not change. Accordingly, unlike the conventional apparatus, mechanical noise is reduced to substantially zero. Also, structural reinforcement is required only in one uniform direction. As a consequence, the structure is simplified and limitations of space and layout are reduced.

Figure 3:
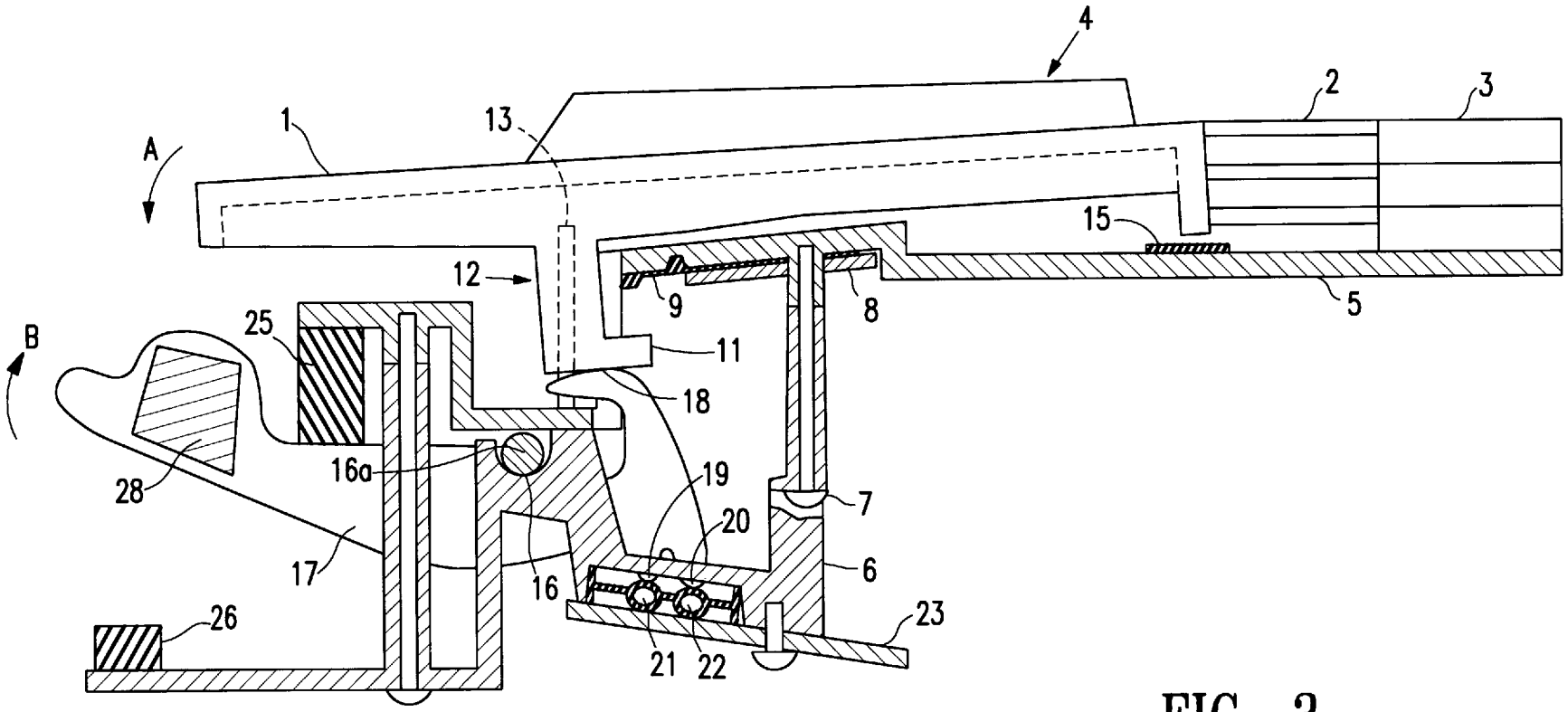
FIG. 3 shows a cross-sectional view of a keyboard apparatus in accordance with another embodiment of the present invention.

FIG. 3 shows the keyboard apparatus of FIG. 1 in the key depression state. Upon depression of the key 1, the key 1 rotates about the hinge section 2 in the direction of an arrow A. At this moment, the horizontal section 11 of the protrusion 12 of the key pushes down the abutting section 18 of the hammer 17. As a result, the hammer 17 rotates about the rotation support section 16 in the direction of an arrow B and abuts against the stopper 25. In the course of the key depression stroke, the actuators 19 and 20 of the hammer successively depress the electric conductive rubber switches 21 and 22 to generate make-signals at two stages. As a result, a key-on signal for the depressed key and/or a key depression speed signal are generated, and these signals are used for controlling musical sounds.

Figure 4:
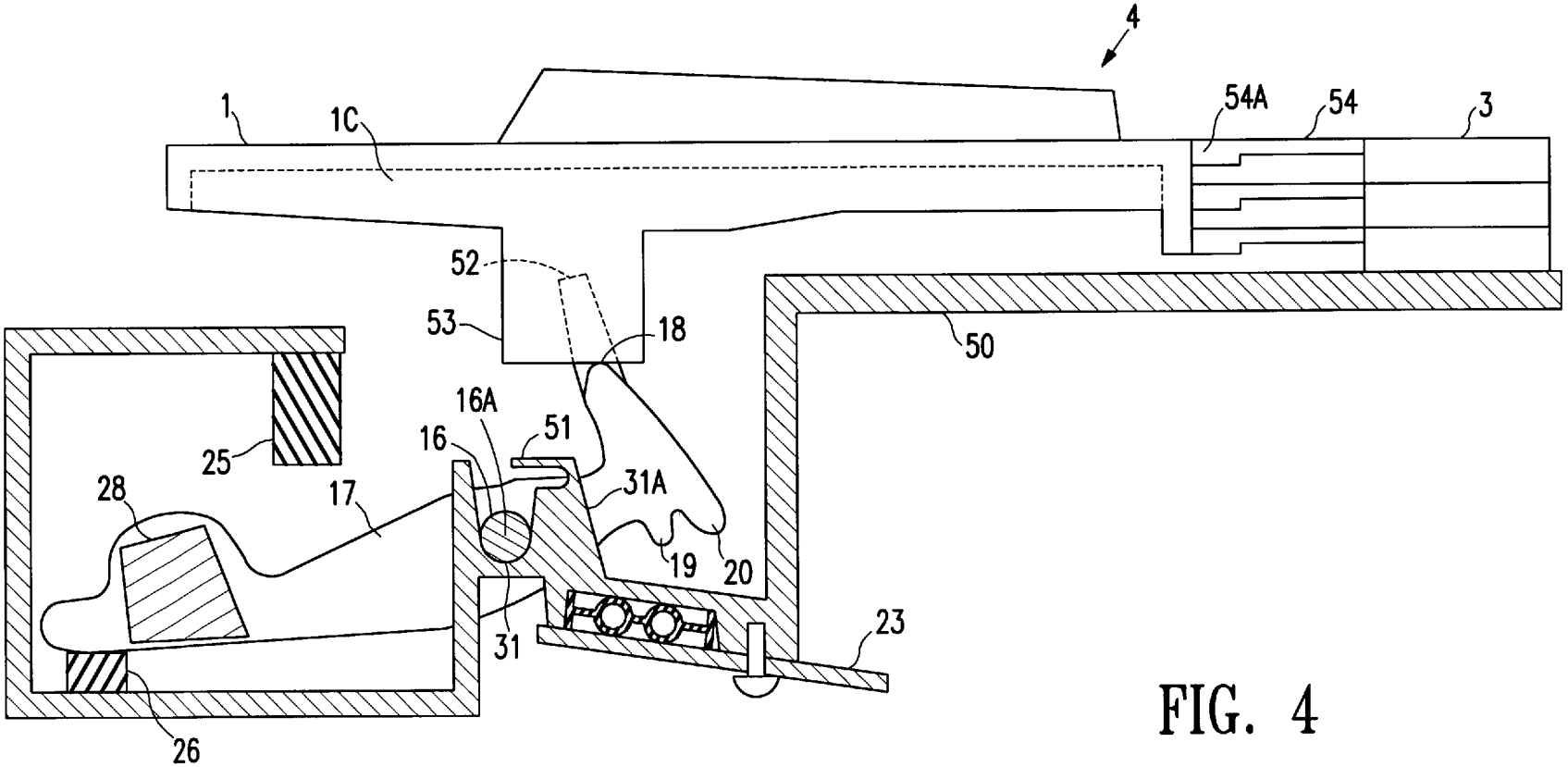
FIG. 4 shows a cross-sectional view of another embodiment of the present invention.

FIG. 4 shows another embodiment of the present invention. It is noted that the same reference numerals are used in the following embodiments for elements that are similar to those shown in FIGS. 1 and 3. In the embodiment shown in FIG. 4, a hinge section 54 is made of a thin plate member that has a thicker section 54*a* (alternatively, a wider section) to restrict yawing of the key 1 (or movement of the key 1 in the key-arrangement direction). As a result, rigidity in the lateral direction (the key arrangement direction) is increased and yawing is substantially prevented when the key 1 is depressed. Accordingly, a key guide (equivalent to the guide member 13 of FIG. 1) may not be required. In this manner, the key 1 is positioned at a specified location with respect to the key arrangement direction, and the key depression operation is achieved without using a key guide (while still minimizing yawing).

In accordance with the embodiment shown in FIG. 4, the key 1 is used to guide, drive and rotate a hammer 17 without causing the hammer 17 to yaw. In a preferred embodiment, the key 1 has a U-shaped cross-section having side walls 1*c* and guide plates 53 downwardly extending from the side walls 1*c*. The hammer 17 is provided with a guide member 52 that is placed between and in sliding contact with the guide plates 53.

Upon depression of the key 1, lower ends of the guide plates 53 of the key 1 push down an abutting section 18 of the hammer 17. As a result, the guide member 52 of the hammer 17 is slidably guided between the guide plates 53 of the key, and the hammer 17 is rotated about the rotation support section 16.

Both the key 1 and the hammer 17 are mounted and supported on a common support frame 50. A rotation support section 16 of the hammer 17 is mounted in a support bearing section 31 that is formed as a recess of the support frame 50. In this embodiment, the rotation support section 16 itself is not positioned at a specified location with respect to the key arrangement direction (in the direction perpendicular to the figure). The positioning of the rotation support section 16 with respect to the key arrangement direction is achieved by coupling the guide member 52 of the hammer 17 with the guide plates 53 of the key 1. A flexible section 51 is provided at an upper section 31*a* of the support bearing section 31. The flexible section 51 functions as a retainer that prevents the rotation support section 16 of the hammer 17 from falling out of the support bearing section 31.

Other structures and effects are the same as those of the first embodiment shown in FIG. 1.

Figure 5A:
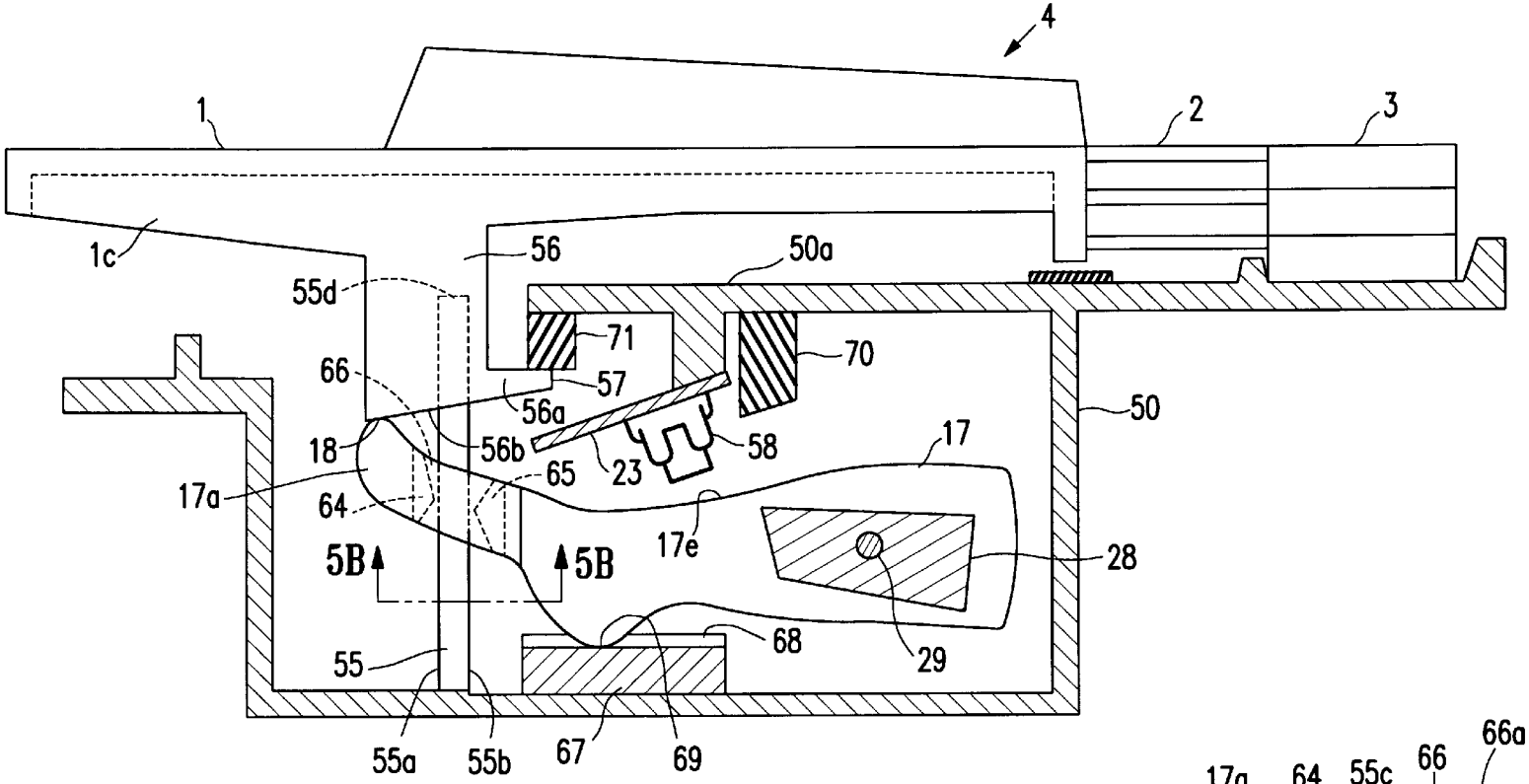
FIG. 5(A) shows a cross-sectional view of another embodiment of the present invention.
Figure 5B:
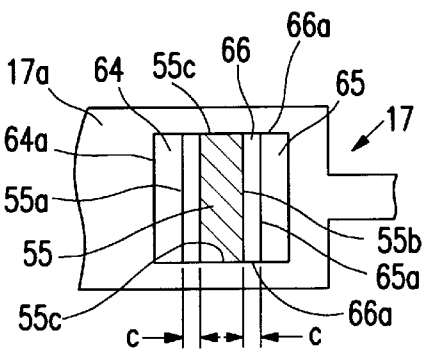
FIG. 5(B) shows a cross-sectional view taken along a line A—A in FIG. 5(A).

FIGS. 5(A) and 5(B) show still another embodiment of the present invention. As shown in FIG. 5(A), a key 1 is moveably supported on a common support frame 50 in the same manner as the above-described embodiments. A hammer 17 is slidably supported on a sliding movement support member 67. A sliding coupling section 69 of the hammer 17 is slidably mounted within a sliding movement groove 68 that is formed in a top surface of the sliding movement support member 67. In an alternative embodiment, the upper surface of the sliding movement support member 67 may be provided with a planer sliding movement surface instead of providing the groove. The hammer 17 swings and moves on the sliding movement support member 67 about the sliding coupling section 69 in association with the key depression operation.

The support frame 50 includes a guide member 55 that guides the key 1 and the hammer 17. The hammer 17 includes a through hole 66. The guide member 55 passes through the through hole 66 of the hammer 17. Protruded wall sections 64 and 65 are formed in the through hole 66 that face a front section 55*a* and a rear section 55*b* of the guide member 55, respectively. As shown in FIG. 5(B), clearances C are provided between apexes 64*a* and 65*a* of the protruded wall sections 64 and 65 and the guide member 55. Side walls 55*c* of the guide member 55 in a right-to-left direction (the key arrangement direction) are generally in sliding contact with internal walls 66*a* of the through hole 66 of the hammer 17. By this structure, the hammer 17 is positioned at a specified location with respect to the key arrangement direction and with respect to the key front-to-rear direction, and moveable about the sliding coupling section 69 within a range allowed by the clearances C.

The key 1 has a U-shaped cross-section having side walls 1*c* and guide plates 56 extending from the side walls 1*c*. Protrusions 57 generally horizontally extend from lower end sections 56*a* of the guide plates 56. An upper section 55*d* of the guide member 55 is inserted between the guide plates 56 of the key 1 and is in sliding contact with the guide plates 56 to guide the key 1, substantially preventing yawing and rolling of the key 1 during the key depression operation. Accordingly, the guide member 55 in this embodiment functions as a common guide for guiding both the hammer 17 and the key 1.

In the embodiment shown in FIG. 5(A), the key guide structure is achieved by providing the guide plates 56 on the key 1 and slidably coupling the guide plates 56 with the upper section 55*d* of the guide member 55. In an alternative embodiment, the rigidity in the lateral direction of the hinge section 54 of the key 1 is increased in a similar manner shown in FIG. 4 to restrict yawing. In this case, the guide member 55 may function only as a hammer guide.

Figure 8:
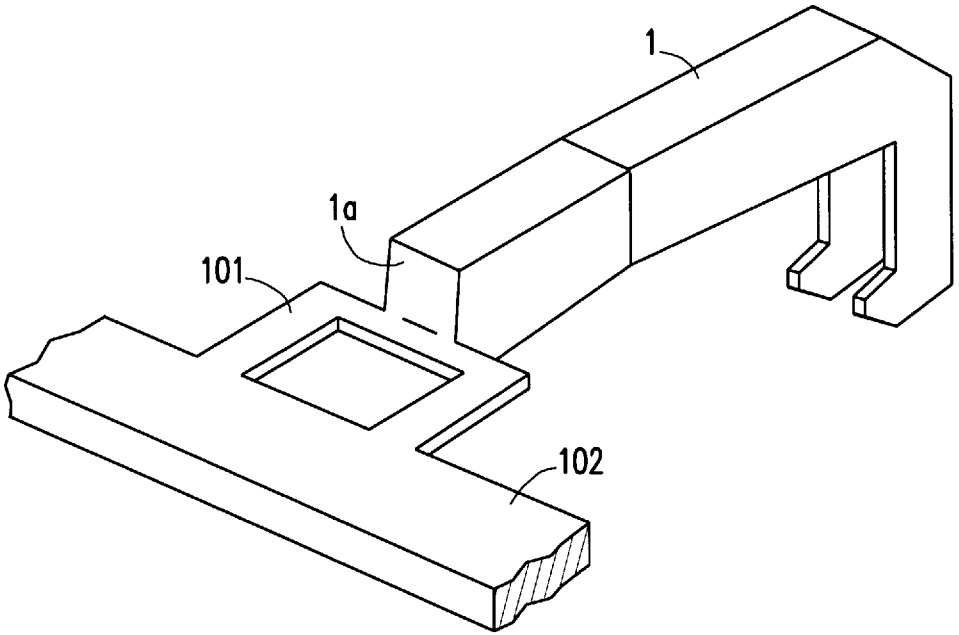
FIG. 8 shows a perspective view of a key-yawing prevention device.

In accordance with one embodiment of the present invention, FIG. 8 shows a key 1 having such a structure described above in which the rigidity in the lateral direction of the key 1 is increased to restrict yawing. As shown in FIG. 8, the key 1 has a wide section 101 formed at a base end section 1*a* (a mounting base section) of the key 1. In the illustrated embodiment, the wide section 101 is defined by a generally rectangular frame or a generally U-shaped frame. The key 1 connects to a key support frame 102 through the wide section 101. As a result, rigidity in the lateral direction (in the key arrangement direction) of the key is increased, and thus the movement in the right-to-left direction (yawing) is restricted.

Referring again to FIG. 5(A), a printed circuit board 23 is affixed to the support frame 50 adjacent a central area 50*a* thereof and at a location opposing the hammer 17. A two-make type rubber switch 58 for each of the keys 1 is mounted on the printed circuit board 23. The rubber switch 58 functionally corresponds to the electric conductive rubber switches 21 and 22 described above in the other embodiments. Upon key depression, the rubber switch 58 is depressed by a central upper edge portion 17*e* of the hammer 17 and is elastically deformed. As a result, the switch 58 is turned on in two stages and provides a key-on signal and/or a key depression speed signal.

A first stopper 70 is provided on the support frame 50 adjacent the printed circuit board 23. The first stopper 70 restricts motions of the hammer 17 upon key depression. Further, a second stopper 71 is provided on the support frame 50 at a location where the second stopper 71 engages the protrusions 57 of the key 1. The second stopper 71 restricts motions of the key 1 upon release of the key 1. Since the hammer 17 moves in association with the releasing operation of the key 1, the second stopper 71, in effect, functions as a stopper for restricting motions of the hammer 17 upon release of the key 1.

A tip section 17*a*' of the hammer 17 has substantially the same width as the key 1. Upon key depression, the hammer 17 is pushed and driven by lower edges 56*b* of the guide plates 56 of the key 1 at an abutting section 18 between the hammer 17 and the lower edges 56*b* of the guide plates 56.

Figure 6:
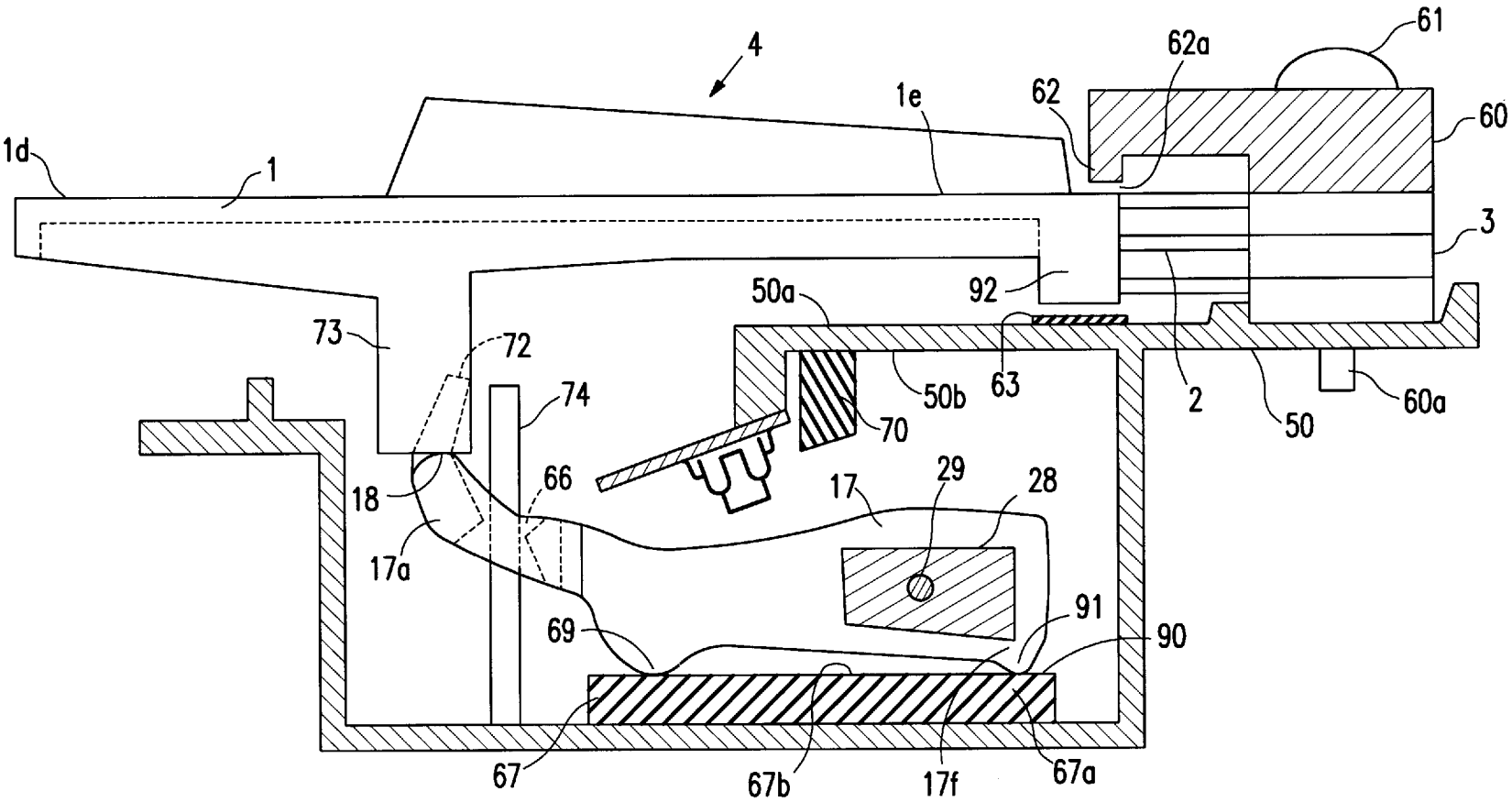
FIG. 6 shows a cross-sectional view of another embodiment of the present invention.

FIG. 6 shows a structure of a keyboard apparatus in accordance with a further embodiment of the present invention. In this embodiment, a hammer 17 includes a through-hole 66, and a guide member 74 passes through the through-hole 66, in the same manner as the embodiment shown in FIG. 5(A). As a result, the hammer 17 is positioned at a specified location with respect to the key arrangement direction and key front-to-rear direction, and is moveably mounted within the keyboard apparatus. Also, the key 1 has guide plates 73, and the hammer has a guide member 72 that is inserted between the guide plates 73 in the same manner as the embodiment shown in FIG. 4. The guide member 72 is in sliding contact with the guide plates 73 to guide the key depression motion and the key release motion.

A first stopper 70 is provided on a lower surface 50*b* of a support frame 50 in a central area 50*a* thereof in the same manner as the embodiment shown in FIG. 5(A). The first stopper 70 restricts rotational movement of the hammer 17 upon key depression. In this embodiment, a second stopper 90 is formed adjacent one edge section 67*a* of an upper surface 67*b* of a sliding movement support member 67, and an abutting section 91 that abuts against the second stopper 90 is formed adjacent one end section 17*f* of the hammer 17. By the second stopper 90, rotational movements of the hammer 17 are restricted upon key release.

In the embodiment shown in FIG. 6, a key unit 4 has a base section 3 that is clamped between a retainer member 60 and the support frame 50. The base section 3 is fixed to the support frame 50 by screws 61. The retainer member 60 includes an upper stopper 62 located opposite a coupling section 92 adjacent the rear end of the key 1. The coupling section 92 of the key 1 connects to a hinge section 2 that is made of a thin plate member. A lower stopper 63 is provided on the support frame 50 below the coupling section 92 of the key 1. The upper stopper 62 and the lower stopper 63 prevent the hinge section 2 of the thin plate members from excessively deforming when excessive force is applied on the key 1 and the frame 50, respectively. For example, when a depressible front section 1*d* of a white key 1 is depressed with a substantially strong force, the key 1 has a counter-clockwise moment force about the abutting section 18 between the hammer 17 and the key 1. As a result, the thin plate members of the hinge section 2 deform upwardly. However, the displacement of the hinge section 2 is restricted by the upper stopper 62. Accordingly, excessive deformation is substantially prevented and the resultant destruction is prevented.

When a depressible rear end section 1*e* of the key 1 is depressed with a substantially strong force, a clockwise moment force is generated about the abutting section 18 between the hammer 17 and the key 1. As a result, the thin plate members of the hinge section 2 deform downwardly.

However, the displacement of the thin plate members of the hinge section 2 is restricted by the lower stopper 63. Accordingly, excessive deformation is substantially prevented and the resultant destruction is prevented.

In the embodiment shown in FIG. 6, the retainer member 60 that defines the upper stopper 62 directly retains the base section 3 of the key and is fixed to the support frame 50 at a point 60*a*. As a result, the distance between the stopper 62 and the fixing point 60*a* is shorter and therefore the mechanical strength of the stopper 62 is greater, compared with a structure in which an upper stopper is fixed to the support frame in the rear of the base section 3. Moreover, the position of the stopper 62 and a clearance 62*a* between abutting surfaces of the stopper 62 and the key 1 are accurately maintained. As a result, secure stopper action and improved reliability are achieved. Furthermore, the number of assembly steps and parts, such as screws and the like, are reduced, and the structure of the keyboard apparatus is simplified. As a consequence, efficiency in the assembly work is improved, cost is reduced and a smaller keyboard apparatus is achieved because the space within the apparatus is more effectively utilized.

Figure 7:
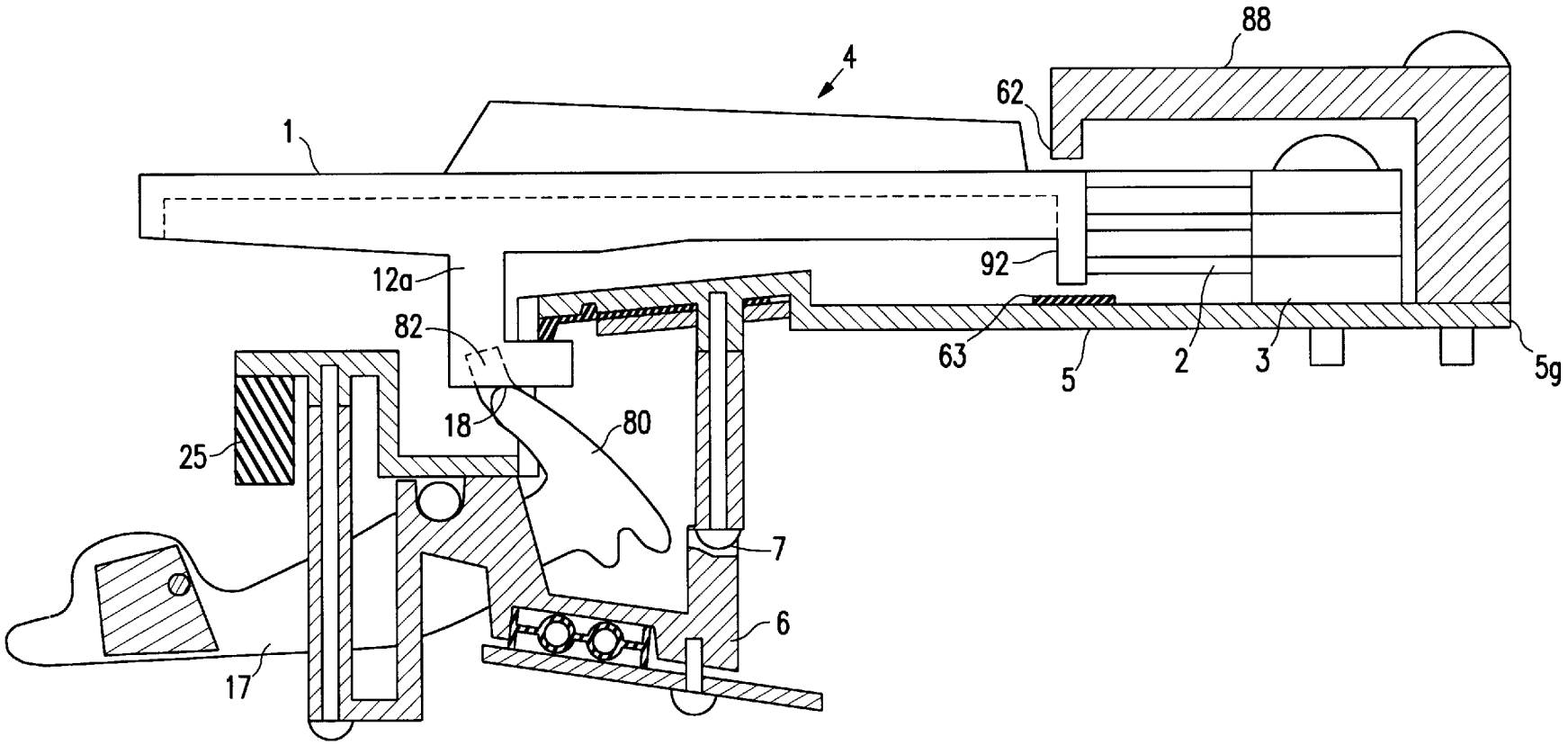
FIG. 7 shows a cross-sectional view of another embodiment of the present invention.

FIG. 7 shows a structure in accordance with another embodiment of the present invention. In this embodiment, a key 1 has an L-shaped protrusion 12*a*. A hammer 17 includes a guide member 82 that is inserted in the L-shaped protrusion 12*a*. As a result, the hammer 17 is driven in association with depression of the key 1, in the same manner as the embodiment shown in FIG. 4. In this embodiment, the key 1 has a hinge section 2 that is made from a thin plate member. The hinge section 2 may be made broad enough to increase its rigidity in the lateral direction to substantially prevent yawing. A stopper support member 88 is fixed to a rear end section 5*g* of a key frame 5. The stopper support member 88 has an upper stopper 62. The upper stopper 62 opposes an upper surface of a coupling section 92 of the key 1 that connects to the hinge section 2, in the same manner as the embodiment shown in FIG. 6. A lower stopper 63 is provided on the key frame 5 below the coupling section 92. Other structures and effects are basically the same as those of the embodiment shown in FIG. 1.

Figure 9:
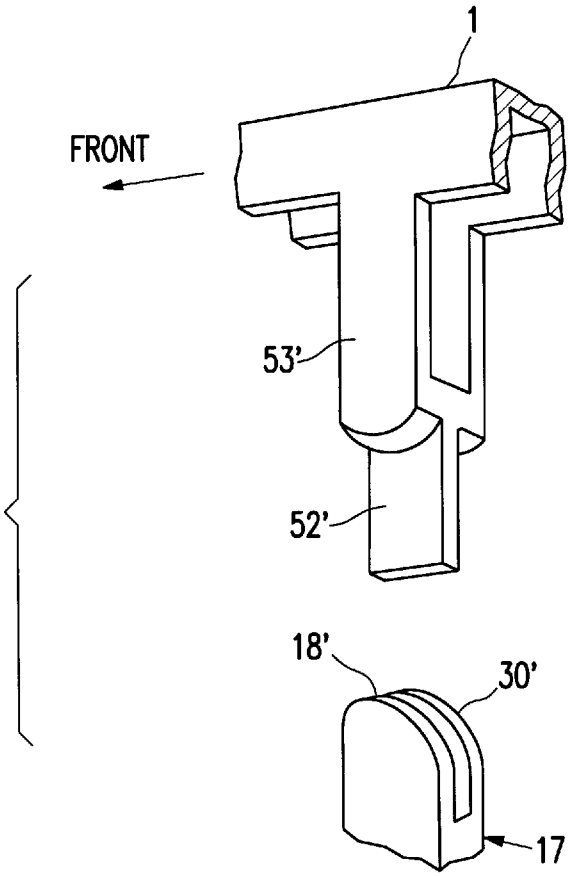
FIG. 9 shows a perspective view of an assembly of sliding coupling components in accordance with an embodiment of the present invention.

FIG. 9 shows a structure of components in accordance with one embodiment of the present invention. This embodiment shows a variation of the sliding coupling section between the key 1 and the hammer 17 shown in FIG. 4. More specifically, in the embodiment shown in FIG. 4, the sliding coupling section 1 8 includes the guide plates 53 of the key 1 and the guide member 52 of the hammer inserted between the guide plates 53. Instead, in accordance with the embodiment shown in FIG. 9, a key 1 has guide plates 53' downwardly extending from the key 1 and a guide member 52' that extends from the guide plates 53'. A hammer 17 includes a pair of guide plates 30'. The guide member 52' of the key 1 is inserted between the guide plates 30' of the hammer 17 to define a sliding coupling section 18'. Other structures and effects are basically the same as the embodiment shown in FIG. 1.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A keyboard apparatus comprising:

a support member;

at least one key moveably supported on the support member and having an abutting section;

a mass member having a support section moveably supported on the support member and driven by the key at the abutting section; and a guide device for guiding the mass member and positioning the mass member with respect to a key arrangement direction at a position removed from the support section.

2. The keyboard apparatus as defined in claim 1, wherein the key is moveable in a key-depression direction, the mass member is moveable in a specified rotation direction, and the guide device commonly guides the key in the key-depression direction and the mass member in the specified rotation direction of the mass member.

3. The keyboard apparatus as defined in claim 2, wherein the guide member substantially restricts movement of the mass member and the key in the key arrangement direction.

4. The keyboard apparatus as defined in claim 1, wherein the guide member substantially restricts movement of the mass member in the key arrangement direction.

5. The keyboard apparatus as defined in claim 1, wherein the key includes:

a depressible key front end section;

a depressible key rear end section, the key abutting section being located below and between the depressible key front end section and the depressible key rear end section;

a rear end section;

a flexible plate member; and a base section connected to the rear end section by the flexible plate member, the base section of the key being connected to the support member so that the key is moveable due to flexible deformations of the flexible plate member, and an upper stopper and a lower stopper are respectively provided above and below a connection section between the rear end section and the flexible plate member, for preventing excessive deformation of the flexible plate member.

6. The keyboard apparatus as defined in claim 5, wherein the base section is located between the upper and lower stoppers.

7. A keyboard apparatus comprising:

a support member;

a key moveably supported on the support member;

a mass member driven by the key and moveably supported on the support member; and a common guide member that moveably guides and positions the key and the mass member with respect to a key arrangement direction.

8. The keyboard apparatus as defined in claim 7, wherein the key and the mass member abut against each other at an abutting section that is located adjacent the common guide member, and the mass member is driven by the abutting section.

9. The keyboard apparatus as defined in claim 7, wherein the support member has a sliding coupling section, the key has a key abutting section, the mass member is slidably supported on the sliding coupling section and is driven through the key abutting section, and the common guide member guides and positions the mass member with respect to a key arrangement direction and a key front-to-rear direction transverse to the key arrangement direction.

10. The keyboard apparatus as defined in claim 7, further comprising:

a yaw minimizing device, wherein the key has a key supporting section and a key abutting section, the key moveably supported through the key supporting section, the mass member is driven through the key abutting section, the mass member being positioned by the support member with respect to a key arrangement direction, and one of the key and the mass member is slidably inserted in the other and substantially prevented from yawing by the yaw minimizing device.

11. The keyboard apparatus as defined in claim 7, further comprising:

a first stopper that restricts movement of the mass member caused by a key depression operation; and a second stopper that restricts movement of the mass member caused by a key release operation, wherein the support member has a sliding contact section, the key has a key abutting section, the mass member has a rotation center section, a sliding coupling point in contact with the key abutting section, and a center of gravity on an opposite side of a vertical plane oriented in the key arrangement direction and including the sliding coupling point with respect to the rotation center section, the mass member is moveably supported on the sliding contact section and is driven by the key abutting section, when the mass member abuts against the first stopper, the first stopper is positioned between a plane perpendicular to a line connecting the sliding coupling point and the center of gravity and including the sliding coupling point and a plane perpendicular to a line connecting the sliding coupling point and the center of gravity and including the center of gravity, and when the mass member abuts against the second stopper, the second stopper is positioned adjacent the center of gravity and outside an area between a plane perpendicular to a line connecting the sliding coupling point and the center of gravity and including the sliding coupling point and a plane perpendicular to the line connecting the sliding coupling point and the center of gravity and including the center of gravity.

12. The keyboard apparatus as defined in claim 7, further comprising:

a first stopper that restricts movement of the mass member caused by a key depression operation; and a second stopper that restricts movement of the mass member caused by a key release operation, p1 wherein the support member includes a sliding contact section, the key includes a key abutting section and a key supporting section, the key being moveably supported at the key supporting section, the mass member is driven by the key abutting section, the mass member has a sliding coupling section and a center of gravity on an opposite side of a vertical plane oriented in a key arrangement direction and including the sliding coupling section with respect to a rotation center of the mass member, and p1 when the mass member abuts against the first stopper, the first stopper is positioned between a plane perpendicular to a line connecting the sliding coupling section and the center of gravity and including the sliding coupling section and a plane perpendicular to the line connecting the sliding coupling section and the center of gravity and including the center of gravity.

13. A keyboard apparatus comprising:

a support member including a key rotation support section and a mass member moveable support section;

at least a key moveable in a key-depression direction and having a rotation fulcrum section rotatably supported by the key rotation support section;

a mass member having a moveable section supported on the mass member moveable support section, the moveable section moveable in a rotation direction of the mass member:

a key guide device for guiding the key in the key-depression direction; and a mass member guide device for guiding the mass member in the rotation direction of the mass member, the key guide device and the mass member guide device being located substantially at a same location with respect to a key-front-to-rear direction, wherein the key guide device and the mass member guide device are formed from a common guide member.

14. The keyboard apparatus as defined in claim 13, wherein the common guide member and the support member are integrally formed in a unit.

15. The keyboard apparatus as defined in claim 14, wherein the common guide member substantially restricts movement of the key and the mass member in a key arrangement direction.

16. A keyboard apparatus comprising:

a support member;

at least one key rotatably supported on the support frame and having an abutting section;

a mass member moveably supported on the support member and driven by the key at the abutting section, the mass member having a center of rotation and a center of gravity on an opposite side of the key abutting section with respect to a vertical plane including the center of rotation;

a first stopper that restricts movement of the mass member caused by a key depression operation; and a second stopper that restricts movement of the mass member caused by a key release operation, wherein when the mass member abuts against the first stopper, the first stopper is positioned between a plane perpendicular to a line connecting the center of rotation and the center of gravity and including the center of rotation and a plane perpendicular to the line connecting the center of rotation and the center of gravity and including the center of gravity, and when the mass member abuts against the second stopper, the second stopper is positioned adjacent the center of gravity and outside an area between a plane perpendicular to a line connecting the center of rotation and the center of gravity and including the center of rotation and a plane perpendicular to the line connecting the center of rotation and the center of gravity and including the center of gravity.

17. A keyboard apparatus comprising:

a support member;

at least one key rotatably supported by the support member and including a key abutting section;

a mass member rotatably driven by the key at the key abutting section, the mass member including a rotation center section and a center of gravity on an opposite side of the key abutting section with respect to a vertical plane including the rotation center section;

a first stopper that restricts rotational movement of the mass member caused by a key depression operation; and a second stopper that restricts rotational movement of the mass member caused by a key release operation, wherein when the mass member abuts against the first stopper, the first stopper is positioned between a plane perpendicular to a line connecting the rotation center section and the center of gravity and including the rotation center section and a plane perpendicular to the line connecting the rotation center section and the center of gravity and including the center of gravity.

18. A keyboard apparatus comprising:

a support member;

a key moveably supported on the support member;

a key guiding protrusion member connecting to the key; and a mass member moveably supported by the support member and driven by the key, wherein the key guiding protrusion member includes a vertical member downwardly extending from the key and a horizontal section horizontally extending from the vertical section, and the mass member is driven by the key guiding protrusion member.

* * * * *